US009022298B2

(12) United States Patent
Catteau et al.

(10) Patent No.: US 9,022,298 B2
(45) Date of Patent: May 5, 2015

(54) RADIANT HEAT REFLECTOR AND HEAT CONVERTER

(75) Inventors: Jean-Pierre Catteau, Grezieu la Varenne (FR); Gerald Capaldini, Lyons (FR)

(73) Assignee: Reznor LLC, Memphis, TN (US)

( * ) Notice: Subject to any disclaimer, the term of this patent is extended or adjusted under 35 U.S.C. 154(b) by 1266 days.

(21) Appl. No.: 12/563,428

(22) Filed: Sep. 21, 2009

(65) Prior Publication Data

US 2011/0049253 A1 Mar. 3, 2011

Related U.S. Application Data

(60) Provisional application No. 61/237,376, filed on Aug. 27, 2009.

(51) Int. Cl.

| | |
|---|---|
| ***F24D 3/00*** | (2006.01) |
| ***F24C 15/22*** | (2006.01) |
| ***F24D 5/08*** | (2006.01) |

(52) U.S. Cl.

CPC .. *F24C 15/22* (2013.01); *F24D 5/08* (2013.01)

(58) Field of Classification Search

CPC ..... F24D 3/00; F24D 5/08; F24D 19/062; F24C 15/24; F24C 15/22

USPC ..... 237/70, 56; 126/91 A; 392/407

See application file for complete search history.

(56) References Cited

U.S. PATENT DOCUMENTS

| | | | | | |
|---|---|---|---|---|---|
| 1,744,078 | A | * | 1/1930 | Murray et al. | 165/131 |
| 2,186,296 | A | * | 1/1940 | Hunnerbeck | 52/89 |
| 2,439,038 | A | * | 4/1948 | Cartter | 126/91 A |
| 2,644,736 | A | * | 7/1953 | Atchison | 312/237 |
| 2,696,205 | A | * | 12/1954 | Ruhl | 126/90 R |
| 2,946,510 | A | * | 7/1960 | Galvin | 237/70 |
| 3,310,102 | A | | 3/1967 | Trombe | |
| 3,733,461 | A | | 5/1973 | Rohats | |
| 3,868,823 | A | * | 3/1975 | Russell et al. | 126/600 |
| 3,980,069 | A | * | 9/1976 | Butlak et al. | 126/91 A |
| 4,002,499 | A | | 1/1977 | Winston | |
| 4,142,514 | A | | 3/1979 | Newton | |
| 4,319,125 | A | * | 3/1982 | Prince | 126/92 B |
| 4,398,587 | A | | 8/1983 | Boyd | |

(Continued)

FOREIGN PATENT DOCUMENTS

| | | | |
|---|---|---|---|
| DE | 3903540 | A1 | 8/1990 |
| EP | 2290294 | A1 * | 3/2011 |

(Continued)

OTHER PUBLICATIONS

Petz, DE 3903540 A1 English machine translation, Aug. 9, 1990.*

(Continued)

*Primary Examiner* — Alissa Tompkins

*Assistant Examiner* — Phillip E Decker

(74) *Attorney, Agent, or Firm* — Schwegman Lundberg & Woessner, P.A.

(57) ABSTRACT

A system may include a tube through which hot fluid is transported from one end to another, wherein the tube radiates heat energy and transfers heat energy to surrounding air by convection. The system may also include a reflector that reflects the radiated heat and a hood that captures the heat energy from the surrounding air through convection, wherein the hood radiates the captured heat energy. The reflector may include a bi-involute curved surface.

18 Claims, 16 Drawing Sheets

(56) References Cited

U.S. PATENT DOCUMENTS

| | | | | |
|---|---|---|---|---|
| 4,605,839 | A | 8/1986 | Rasmussen et al. | |
| 4,727,854 | A * | 3/1988 | Johnson | 126/92 B |
| 5,626,125 | A * | 5/1997 | Eaves | 126/91 A |
| 6,138,662 | A * | 10/2000 | Jones | 126/91 A |
| 6,188,836 | B1 | 2/2001 | Glucksman et al. | |
| 6,698,908 | B2 * | 3/2004 | Sitzema et al. | 362/328 |
| 6,837,593 | B1 * | 1/2005 | Schutz et al. | 362/218 |
| 6,905,457 | B2 | 6/2005 | Mackin | |
| 7,067,773 | B2 * | 6/2006 | DeWitt | 219/451.1 |
| 7,116,900 | B2 * | 10/2006 | Johnson | 392/407 |
| 7,497,252 | B2 * | 3/2009 | Pun | 165/247 |
| 2004/0003281 | A1 | 1/2004 | Sonoda et al. | |
| 2009/0202856 | A1 * | 8/2009 | Hiraoka et al. | 428/604 |

FOREIGN PATENT DOCUMENTS

| | | | |
|---|---|---|---|
| JP | 5088086 | A | 4/1993 |
| JP | 06302209 | A | 10/1994 |
| WO | 9113374 | A1 | 9/1991 |
| WO | 9709569 | A1 | 3/1997 |
| WO | WO-2006/106345 | A1 * | 10/2006 |

OTHER PUBLICATIONS

Avallone, et al, Marks' Standard Handbook for Mechanical Engineers, McGraw-Hill, Section 4.3, 1996.*

European Search Report and Written Opinion dated Jan. 27, 2011 issued in corresponding European application No. 10251489.0, 6 pages.

* cited by examiner

FIG. 3A
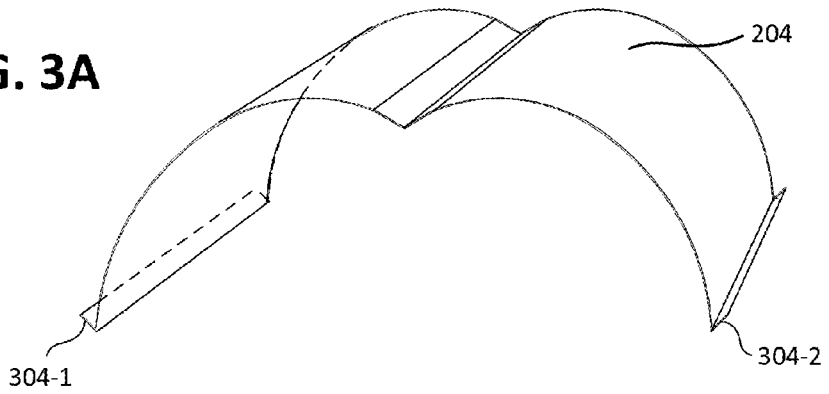
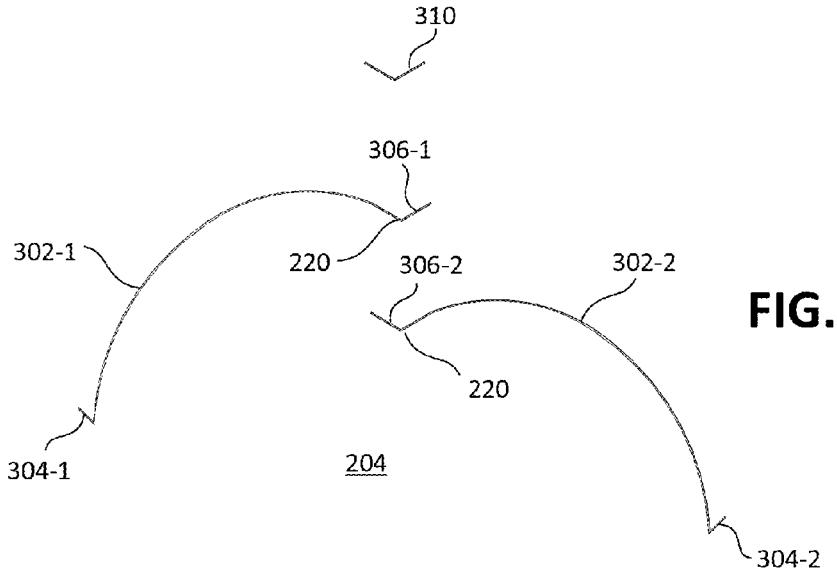
FIG. 3B

RADIANT HEAT REFLECTOR AND HEAT CONVERTER

RELATED APPLICATIONS

This application claims the benefit of U.S. Provisional Patent Application No. 61/237,376 filed Aug. 27, 2009, which is hereby incorporated by reference.

FIELD OF THE INVENTION

Embodiments described herein relate to a radiant heater, and more particularly to a reflector and a heat converter in a radiant heater.

BACKGROUND OF THE INVENTION

Radiant heaters are frequently used in warehouses, factories, and commercial settings to provide a warm environment during cold weather. In such systems, tubular conduits (e.g., "tubes") may hang from the ceiling or other overhead structure. A heated fluid (provided by a power plant) passes through the tube and heats the tube. The tube radiates heat waves (e.g., heat transfer by radiation) to an adjacent area, such as toward the floor. A reflector may direct the radiated heat in a desired direction. A heating system of this type may warm objects or people on loading docks, near open doorways, or where conditions may cause a high heat loss.

BRIEF DESCRIPTION OF THE DRAWINGS

FIG. 3A is a perspective drawing of an exemplary embodiment of a reflector in the exemplary radiant heater of FIGS. 2A and 2B;

FIG. 3B is a disassembled, cross-sectional drawing of the exemplary reflector of FIG. 3A;

DETAILED DESCRIPTION OF THE PREFERRED EMBODIMENTS

The following detailed description refers to the accompanying drawings. The same reference numbers in different drawings may identify the same or similar elements. The foregoing general description and the following detailed description are exemplary and explanatory only and are not restrictive of the invention, as claimed.

Embodiments described herein provide for a reflector to reflect heat radiated from a tube. One of these embodiments allows the reflected heat to avoid the tube itself, e.g., the reflected heat energy being directed around the tube rather than impinging on the tube. Other embodiments provide for a hood converter to capture heat, where the hood may radiate the captured heat.

Figure 1B:
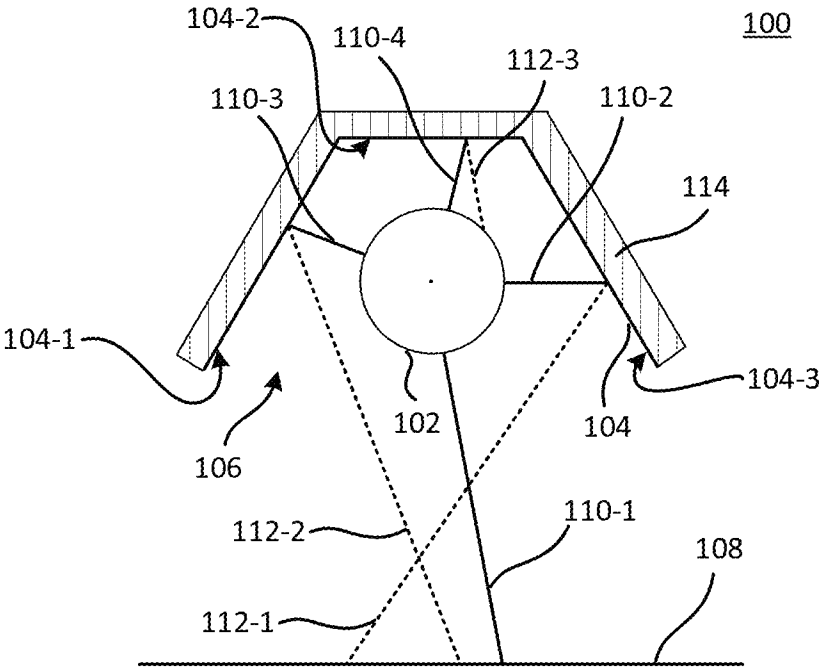
FIG. 1B is a cross-sectional drawing of the radiant heater of FIG. 1A.
Figure 1A:
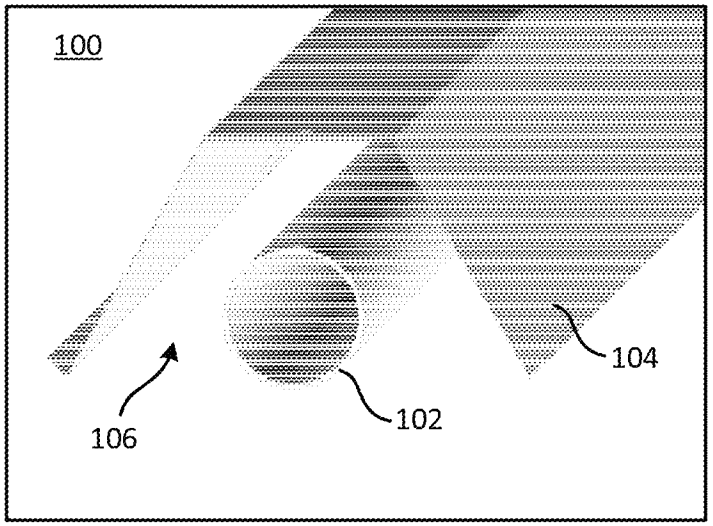
FIG. 1A is a diagram of a radiant heater.

FIG. 1A is a diagram of a radiant heater 100. Radiant heater 100 may hang from a ceiling, for example, for the purpose of radiating heat downward toward a floor. FIG. 1B is a cross-sectional drawing of radiant heater 100 of FIG. 1A. Radiant heater 100 includes an emitting tube 102, a reflector 104, and a space 106 separating emitting tube 102 and reflector 104. Radiant heater 100 may also include an insulation layer 114, shown only in FIG. 1B.

Emitting tube 102 carries a heated fluid (e.g., hot flue gas), which heats emitting tube 102 to high temperatures. As a result, emitting tube 102 radiates heat waves 110 (e.g., heat wave 110-1, 110-2, 110-3, and 110-4, shown in FIG. 1B as solid lines parallel to the direction of travel of the waves). As shown in FIG. 1B, heat wave 110-1 radiates directly toward a floor 108, where the heat is desired, for example. Heat waves 110-2, 110-3, and 110-4, on the other hand, radiate toward reflector 104.

Reflector 104 reflects heat waves 110-2, 110-3, and 110-4 toward floor 108 as reflected heat waves 112 (e.g., heat waves 112-1, 112-2, and 112-3 shown in FIG. 1B as dashed lines parallel to the direction of travel of the waves). Heat wave 112-3, however, is also reflected toward emitting tube 102 and emitting tube 102 may absorb portions of heat wave 112-3 and its energy. In this example, portions of heat wave 112-3 may not reach floor 108 and energy may be potentially lost.

Space 106 and reflector 104 may become hot themselves (e.g., the air in space 106 being in contact with emitting tube 102 (conduction), the convection in the air, and the contact of the air with reflector 104). To slow heat transfer in the upward direction (e.g., away from floor 108) and to reduce heat loss, an insulation layer 114 may reside above reflector 104.

Figure 2A:
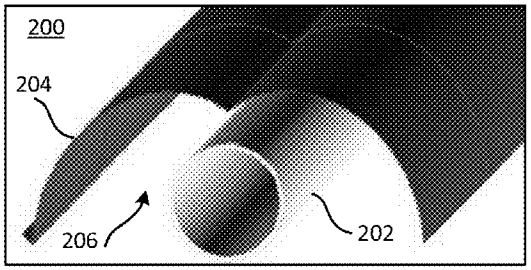
FIG. 2A is a diagram of an exemplary embodiment of a radiant heater.
Figure 2B:
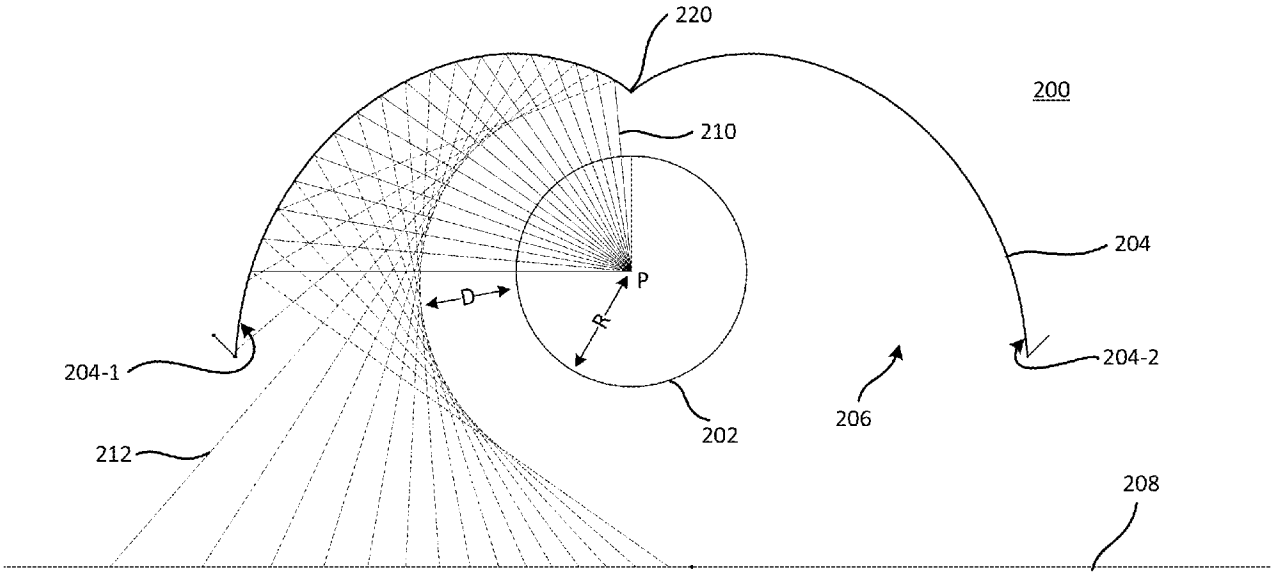
FIG. 2B is a cross-sectional drawing of the exemplary radiant heater of FIG. 2A.

FIG. 2A is a perspective drawing of an exemplary radiant heater 200 in one embodiment. Radiant heater 200, like radiant heater 100, may hang from a ceiling, for example, for the purpose of radiating heat downward toward a floor. FIG. 2B is a cross-sectional drawing of radiant heater 200. Radiant heater 200 includes an emitting tube 202, a reflector 204, and a space 206 separating emitting tube 202 and reflector 204.

Emitting tube 202 carries heated fluid (e.g., hot flue gas), which may heat emitting tube 202 to high temperatures. As a result, emitting tube 202 radiates heat waves 210 (shown in FIG. 2B as solid lines parallel to the direction of travel of the wave). Although emitting tube 102 radiates heat waves in all directions, only heat waves radiated toward the left portion of reflector 204 are shown in FIG. 2B for simplicity.

Reflector 204 reflects heat waves 210 toward a floor 208 as reflected heat waves 212 (shown in FIG. 2B as dashed lines parallel to the direction of travel of the waves). Unlike reflector 104, however, reflector 204 is shaped to reflect heat waves 210 substantially around emitting tube 202. This embodiment may allow for fewer heat waves being reflected back to and be absorbed by emitting tube 202. Instead, this embodiment may allow for more heat waves (e.g., more energy) to be reflected toward floor 208, where the heat is desired. In one embodiment, substantially all the radiation that impinges on reflector 204 is reflected around emitting tube 202. A more detailed description of embodiments of the shape of reflector 204 is discussed below with respect to FIGS. 7A through 7F and 8A through 8D.

As shown in FIG. 2B, reflector 204 may include a first curved surface 204-1 and a second curved surface 204-2 that meet at a junction 220. Emitting tube 202 may be considered a line source P (also referred to as "center axis P" or "point source P") emitting radiation 210. The properties and shape of first surface 204-1 allows emitted radiation 210 to be reflected (e.g., radiation 212) around emitting tube 202, with a clearance distance D. As shown in FIG. 2B, the dimensions of emitting tube 202 may be sized to have a radius greater than R. For example, emitting tube 202 may have a radius of R+D before reflected radiation 212 would impinge on emitting tube 202. The area/volume from line source P to R+D may be known as a reflection-free envelope, inside of which may be substantially free of reflected radiation.

Although emitting tube 202 may be sized larger, in one embodiment emitting tube 202 is kept a distance from the reflection envelope and junction 220. For example, the distance from emitting tube 202 to junction 220 may be between 35 to 40 millimeters (mm), 30 to 35 mm, 25 to 30 mm, 20 to 25 mm, 15 to 20 mm, 10 to 15 mm, 5 to 10 mm, or less than 5 mm. In one embodiment, the distance from emitting tube 202 to junction 220 is 29.29 mm, where the radius of emitting tube 202 is 38.05 mm and the distance between center axis P is 67.34 mm. In another embodiment, the distance from emitting tube 202 to junction 220 is 16.54 mm, where the radius of emitting tube 202 is 50.8 mm and the distance between center axis P is 67.34. The dimensions of emitting tube 202 may also be scaled smaller such that its radius may be smaller than radius R shown in FIG. 2B.

Viewed in another way, the dimensions of reflector 204 may be correspondingly scaled down before reflected radiation 212 would impinge on emitting tube 202. Alternatively, the dimensions of reflector 204 may be increased and reflected radiation 212 may still avoid emitting tube 202. Thus, reflector 204 may be designed to accommodate many different sizes of emitting tubes.

FIG. 3A is a perspective drawing of reflector 204. Reflector 204 may be formed of a metal, such as stainless steel. In one embodiment, reflector 204 is formed of one sheet of metal that is continuous from a first lip 304-1 to a second lip 304-2 (lips 304) of reflector 204. Lips 304 may provide strength to support the weight of reflector 204 when installed and may provide rigidity along the length of reflector 204 (e.g., parallel with emitting tube 202). In this embodiment, reflector 204 may be rolled, drawn, or pressed into the shape shown. In one embodiment, reflector 204 may be constructed of aluminized steel.

In another embodiment, reflector 204 may be formed of multiple (e.g., two) sheets of metal. FIG. 3B is a disassembled, cross-sectional drawing of reflector 204 formed from two sheets of metal. In FIG. 3B, reflector 204 comprises a first sheet 302-1 and a second sheet 302-2. Reflector 204 may include more or fewer portions than shown. First and second sheets 302-1 and 302-2 may be rolled, drawn, or pressed into the shapes shown. Sheets 302-1 and 302-2 may allow for a compact, disassembled reflector 204 for easier transportation of radiant heater 200.

First sheet 302-1 may include first lip 304-1 and a first flange 306-1 that may run along junction 220. Flange 306-1 may provide rigidity along the length of sheet 302-1 and may overlap with a portion of second sheet 302-2 to allow first and second sheets 302-1 and 302-2 to be joined together by, for example, bolts along the length of such an overlap. Second sheet 302-2 may include second lip 304-2 and a second flange 306-2. Flange 306-2 may also overlap with a portion of first sheet 302-1 to allow first and second sheets 302-1 and 302-2 to be joined together by, for example, bolts along the length of such an overlap.

In one embodiment, a joining strip 310 may overlap with first sheet 302-1 and second sheet 302-2 along their lengths. Joining strip 310 may allow first and second sheets 302-1 and 302-2 to be joined together by, for example, bolts along the length of the overlap between joining strip 310 and first sheet 302-1 and bolts along the length of the overlap between joining strip 310 and second sheet 302-2. In an embodiment with joining strip 310, for example, flanges 306-1 and 306-2 may be omitted.

In one embodiment, joining strip 310 is short compared to the length of reflector 204. In this embodiment, multiple joining strips may be used along the length of reflector 204. For example, a joining strip 310 may be used at each end of reflector 204 and a joining strip 310 may be used in the middle of reflector 204.

In test results, reflector 104 (in the configuration of FIG. 1A) was compared to reflector 204 (in the configuration of FIG. 2A). In these test results, reflector 204 (1) increased maximum radiation measured under the radiant heater by 12%; (2) increased global radiation by 1.2%; (3) decreased convective heat from 234° C. to 175° C., (4) lowered the highest temperature (measured on top of emitting tube 102) by 11%, and (5) increased combustion efficiency of the power plant by 0.6%. In the above test results, global radiation was determined by taking the average of the measured radiation impinging on a surface beneath emitting tubes 102 or 202 (e.g., a surface 3 m by 1 m oriented along emitting tubes 102 or 202, 1.74 m below emitting tubes 202 or 102 and 0.46 m from side to side). Convective heat was determined by measuring at 5 cm intervals around the border of reflector 204 or reflector 104. Tests also showed that, in one embodiment, reflector 204 may allow lower temperatures of emitting tube 202 while still increasing radiation and improving combustion parameters.

Figure 4A:
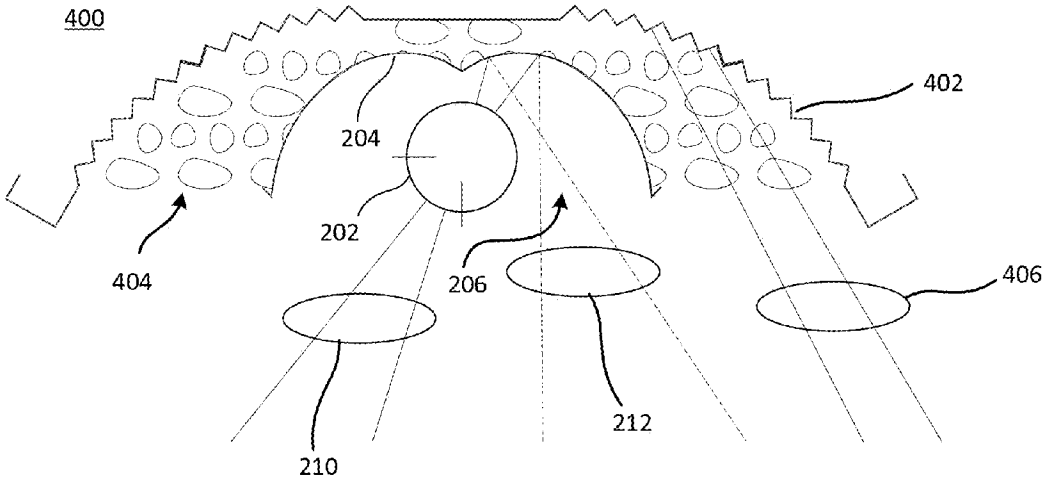
FIG. 4A is a cross-sectional drawing of an exemplary embodiment of a radiant heater with a heat converter hood.
Figure 4B:
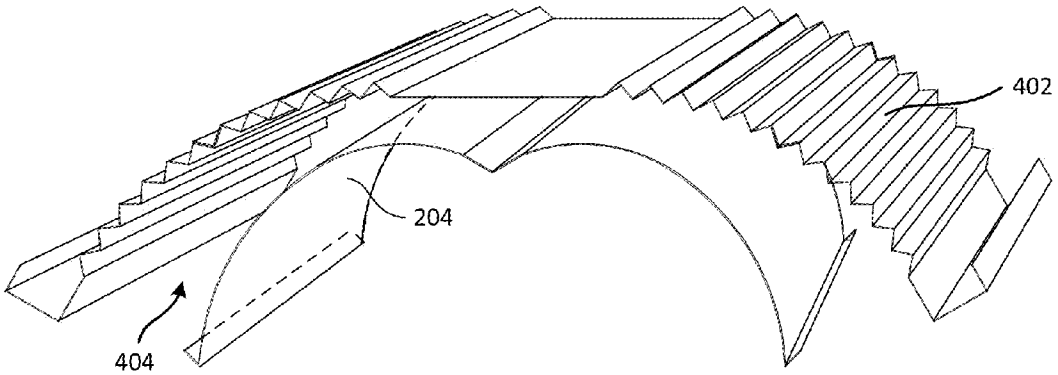
FIG. 4B is a perspective drawing of the exemplary reflector and exemplary heat converter hood of the radiant heater of FIG. 4A.

FIG. 4A is a cross-sectional drawing of one embodiment of an exemplary radiant heater 400 with a heat converter hood 402. As described below, converter hood 402 converts and directs heat energy. Radiant heater 400, like radiant heater 200, includes emitting tube 202 and reflector 204. Converter hood 402 is placed above reflector 204 to form a space 404 between reflector 204 and converter hood 402. FIG. 4B is a perspective drawing of radiant heater 400 showing an exemplary positioning of converter hood 402 with respect to reflector 204. The distance from junction 220 of reflector to converter hood 402 may range, for example, from 40 to 35 mm, 35 to 30 mm, 30 to 25 mm, 25 to 20 mm, 20 to 15 mm, 15 to 10 mm, 10 to 5 mm, or less than 5 mm. In one embodiment, the distance from junction 220 of reflector 204 to converter hood 402 is approximately 24 mm.

Emitting tube 202 becomes hot as a result of hot gasses passing through emitting tube 202. In addition to emitting thermal radiation, emitting tube 202 heats the air in space 206 surrounding emitting tube 202 (e.g., through contact of the air with emitting tube 202, or conduction). Heat may also transfer through the air in space 206 as well as the air in space 404 between reflector 204 and converter hood 402 (e.g., through convection). Reflector 204 may also conduct heat from space 206 to space 404. Hot air in space 404 is depicted in FIG. 4A as amorphous shapes.

Heat may build up in space 404 between reflector 204 and converter hood 402, and particularly at the surface of converter hood 402 by the convection of the air in space 404. As a result, converter hood 402 may capture this heat energy (e.g., become hot itself) and may begin to radiate energy. In other words, converter hood 402 may convert the heat energy transferred through convection to the surface of converter hood 402 into heat energy radiated through space. As shown in FIG. 4A, converter hood 402 radiates heat waves 406 (also referred to as radiation 406, depicted as solid lines in the direction of the travel of the wave). Radiation 406 is in addition to reflected radiation 212 and emitted radiation 210.

Converter hood 402 may include corrugated portions to capture heat more effectively and to help distribute the heat energy throughout space 404. Capturing and converting heat energy around emitting tube 202, by converter hood 402, allows emitting tube 202 to operate at lower temperatures. Operating emitting tube 202 at lower temperatures may extend the life of emitting tube 202, or may allow more hot fluid to pass through emitting tube 202 without reaching its maximum rated temperatures.

Figure 5A:
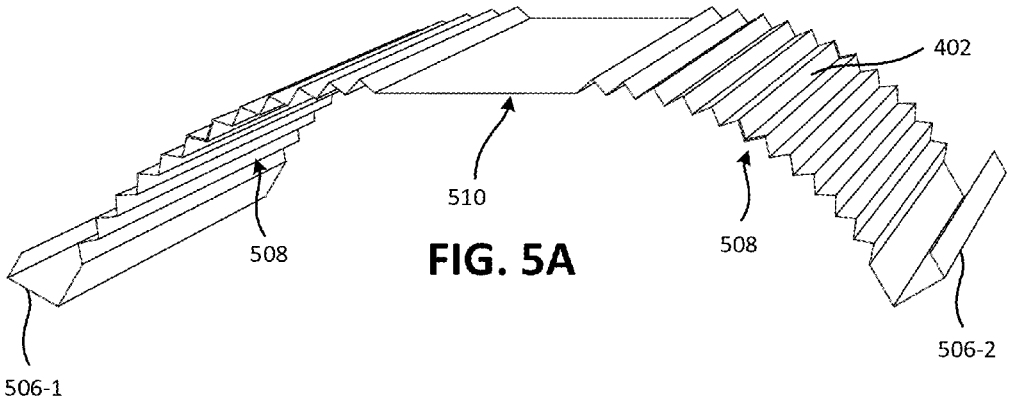
FIG. 5A is a projection drawing of an exemplary converter hood of the radiant heater of FIG. 4A.
Figure 5B:
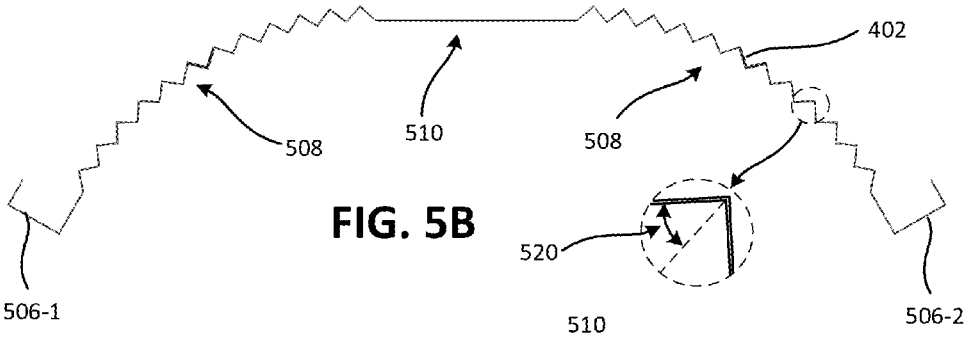
FIG. 5B is a cross-sectional drawing of the exemplary converter hood of FIG. 5A.

FIG. 5A is a perspective drawing of converter hood 402. FIG. 5B is a cross-sectional drawing of converter hood 402. Converter hood 402 may include angled or corrugated portions 508 along the sides and a flat portion 510 along the middle of converter hood 402. Converter hood 402 may be formed from a single piece of sheet metal from one end (e.g., a first flange 506-1) to the other end (e.g., a second flange 506-2). Converter hood 402 may be rolled, drawn, or pressed into the shape.

Corrugated portions 508 may increase the surface area of converter hood 402, allowing it to absorb more heat and convert more energy into radiated heat. In one embodiment, corrugated portions 508 include angles (e.g., angle 520) between 35 to 50° (e.g., 35 to 40°, 40 to 45°, 45 to 50°), 50 to 60°, or 60 to 70°, or 25 to 35°. Corrugated portions 508 may include angles greater than 70° or less than 25°, for example. In one embodiment, corrugated portions 508 include 45° angles, increasing the area of converter hood 402 by a factor of 1.414. Corrugated portions 508 may also trap hot air and allow heat to be more evenly distributed along converter hood 402 than if, for example, converter hood 402 were not corrugated at all, which may result in more hot air accumulating at the top portion of converter hood 402. In another embodiment, corrugated portions may include curves rather than angles.

Flat portion 510 lacks corrugations, which may also help prevent hot air from accumulating at the top portion of converter hood 402. Like corrugated portions 508, flat portion 510 may allow heat to be more evenly distributed along converter hood 402 than if, for example, the top portion were corrugated.

Figure 5C:
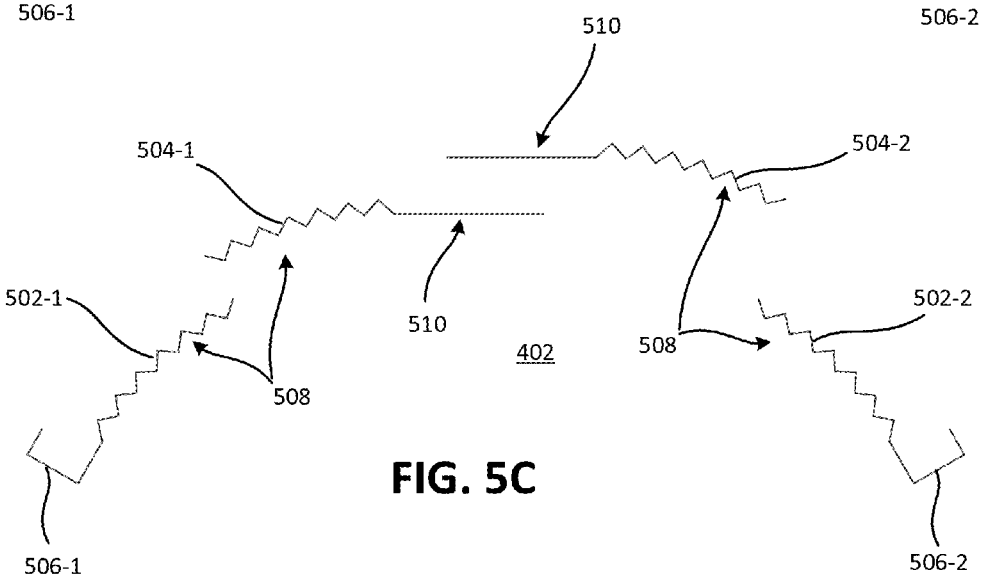
FIG. 5C is a disassembled, cross-sectional drawing of the exemplary converter hood of FIG. 5A.

FIG. 5C is a disassembled, cross-sectional drawing of exemplary converter hood 402. In this embodiment, converter hood 402 may include a first side portion 502-1, a second side portion 502-2, a first top portion 504-1, and a second top portion 504-2. Converter hood 402 may include more or fewer portions than shown. Portions 502-1, 502-2, 504-1, and 504-2 may allow for a more compact, disassembled converter hood 402 for easier transportation of radiant heater 400. Portions 502-1, 502-2, 504-1, and 504-2 may be rolled, drawn, or pressed into the shapes shown.

First side portion 502-1 may include corrugated portion 508 and first flange 506-1. First flange 506-1 may provide for rigidity along the length of converter hood 402. First flange 506-1 may also hold an insulation layer (not shown, discussed below) in place. Corrugated portion 508 may also provide for rigidity along the length of converter hood 402 in addition to the features discussed above. Second side portion 502-2 may include corrugated portion 508 and second flange 506-2, which may provide the same features as the corresponding elements of first side portion 502-1.

First top portion 504-1 may include corrugated portion 508 and flat portion 510. Likewise, second top portion 504-2 may include corrugated portion 508 and flat portion 510. Part of first top portion 504-1 may overlap with first side portion 502-1, allowing first top portion and first side portion 506-1 to be bolted together. Likewise, part of second top portion 504-2 may overlap with second side portion 502-2, allowing second top portion 504-2 and second side portion 502-2 to be bolted together. Part of first top portion 504-1 may also overlap with part of second top portion 504-2, allowing first top portion 504-1 and second top portion 504-2 to be bolted together.

Test results have shown that (1) the radiant heat intensity under radiant heater 400 is approximately 20% higher compared to radiant heater 100, (2) the radiant heat intensity under radiant heater 400 is approximately 12% higher compared to radiant heater 200, without an increase in the temperature of emitting tube 202, and (3) the heat input into emitting tube 202 of radiant heater 400 may be increased by 20% (as compared to radiant heater 100) before reaching the maximum rated temperature of emitting tube 202.

By increasing the heat input 20%, test results have shown that radiant heat intensity under radiant heater 400 is increased 50% (compared to radiant heater 100 at the same temperature of emitting tube 202). Keeping the same maximum-rated temperature on emitting tube 102 and emitting tube 202 (in radiant heater 400), test results showed a gain of 50% in the efficiency with reflector 204 and converter hood 402. Radiant heater 400 showed a radiant heat efficiency of 81% (net caloric value (NCV)) and a total heat output efficiency of 93% NCV. On the other hand, radiant heater 100 showed a radiant heat efficiency of 54% NCV and a total heat output efficiency of 63% NCV.

Figure 6:
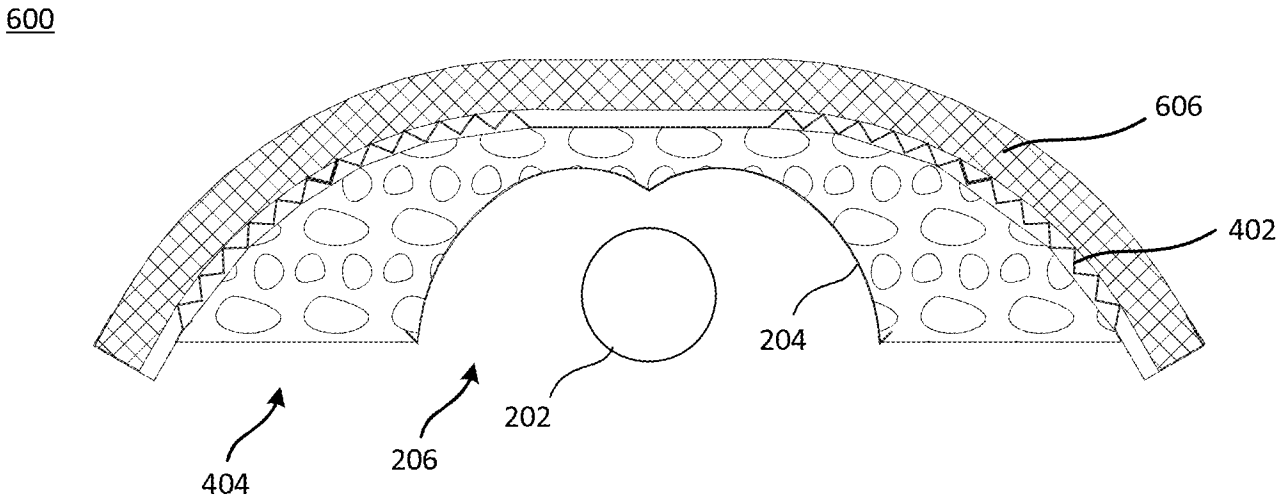
FIG. 6 is a cross-sectional drawing of an exemplary embodiment of a radiant heater including an insulation layer.

FIG. 6 is a cross-sectional drawing of a radiant heater 600 including an insulation layer 606. Radiant heater 600, like radiant heater 200, includes emitting tube 202, reflector 204, and converter hood 402. In one embodiment, emitting tube 202, space 206, reflector 204, space 404, and converter hood 402 may become hot. Insulation layer 606 may reside above converter hood 402. Insulation layer 606 may slow heat transfer in the upward direction and reduce heat loss. As a result, in this embodiment, insulation layer 606 may allow converter hood 402 to reach higher temperatures than without layer 606, allowing hood 402 to reradiate more energy with layer 606 than without layer 606. Converter hood 402 may hold insulation layer 606 in place using flanges 506-1 and 506-2 or other mechanical attachment means.

Figure 7A:
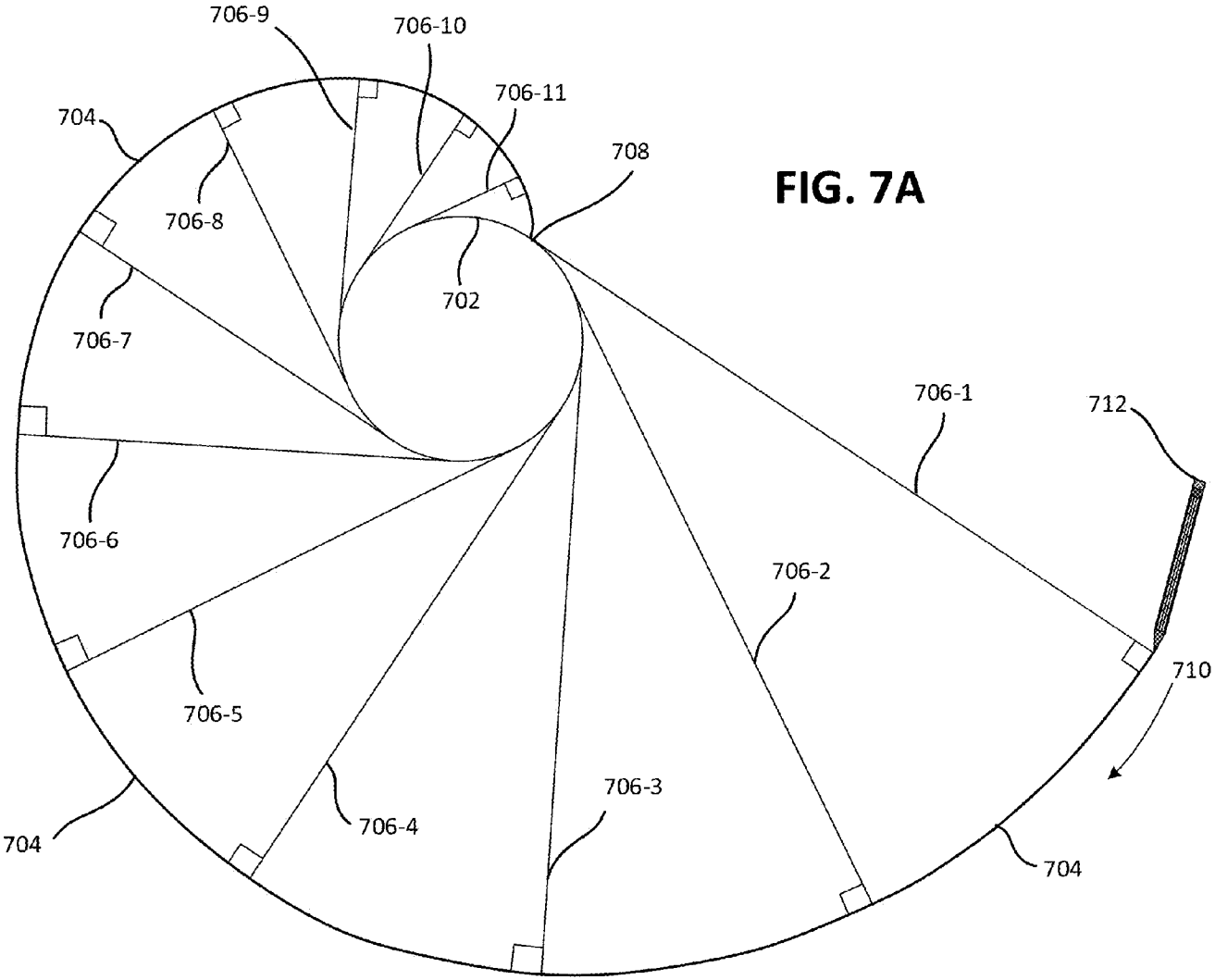
FIGS. 7A through 7F are plots of exemplary curves that describe the reflector of FIG. 3A.

FIG. 7A is a plot of an involute curve 704 of a circle 702, which may be used to define first surface 204-1 and second surface 204-2 of reflector 204 in radiant heater 200. An involute curve may be obtained by attaching an imaginary, taut string to a first curve and tracing the string's free end as it is wound onto that first curve, thus creating the involute curve.

For example, assume that circle 702 is the first curve and that line 706-1 is a string 706 attached to circle 702 at a fixed point 708 on one end, and to a pencil 712 on the other end. Circle 702 may represent an emitting tube, such as emitting tube 202. In this example, the length of string 706 is the same as the circumference of circle 702. As string 706 is moved in a direction 710, string 706 becomes wound around circle 702 and pencil 712 traces involute curve 704. String 706 is shown in many positions (706-1, 706-2, etc.) as string 706 is wound around circle 702. Upon one complete revolution of string 706 around circle 702, involute curve 704 intersects circle 702 at point 708 because the length of string 706 is the same as the circumference of circle 702. Involute curve 704 may also be described as the unwinding of string 706 from circle 702.

Figure 7B:
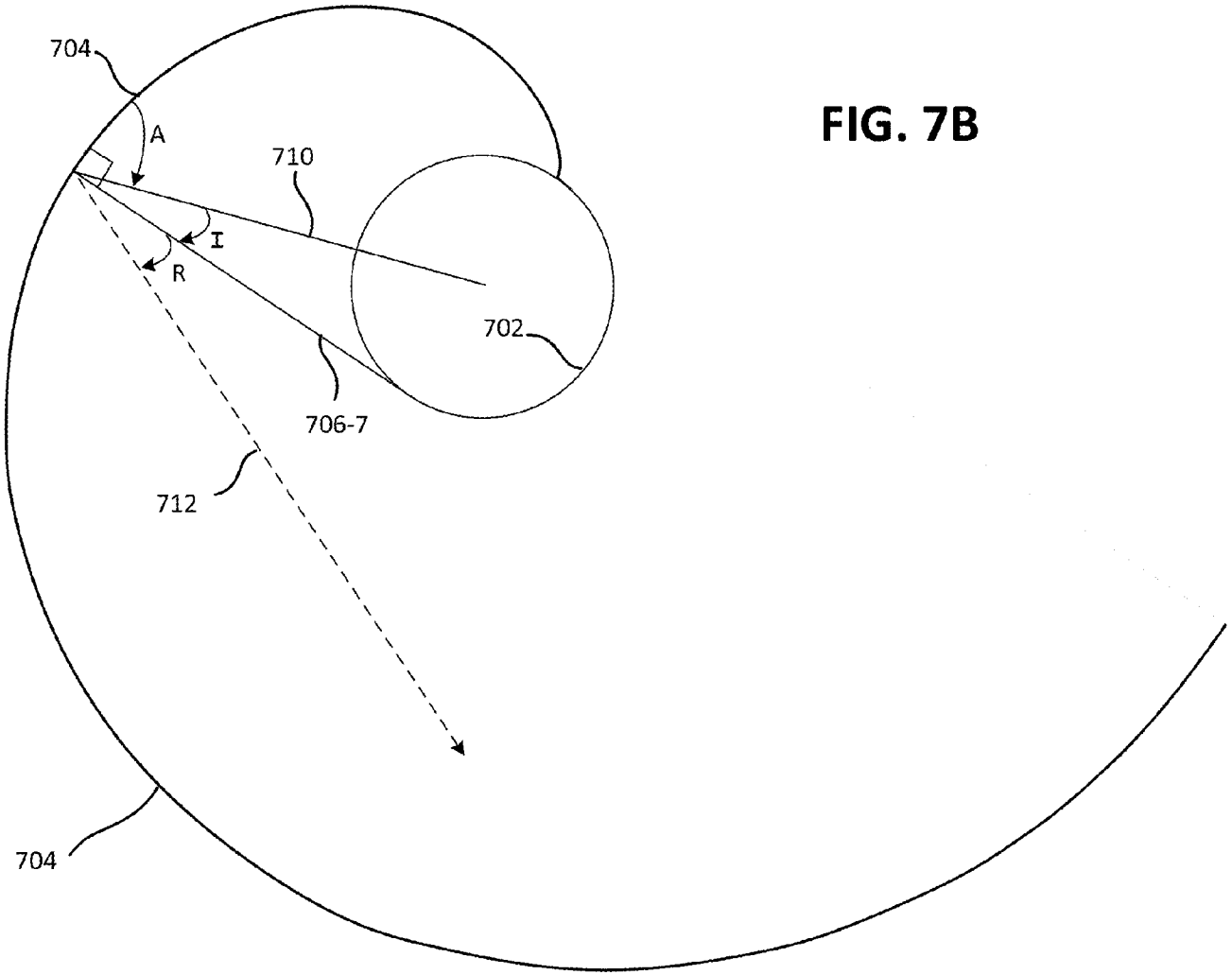
Figure 7C:
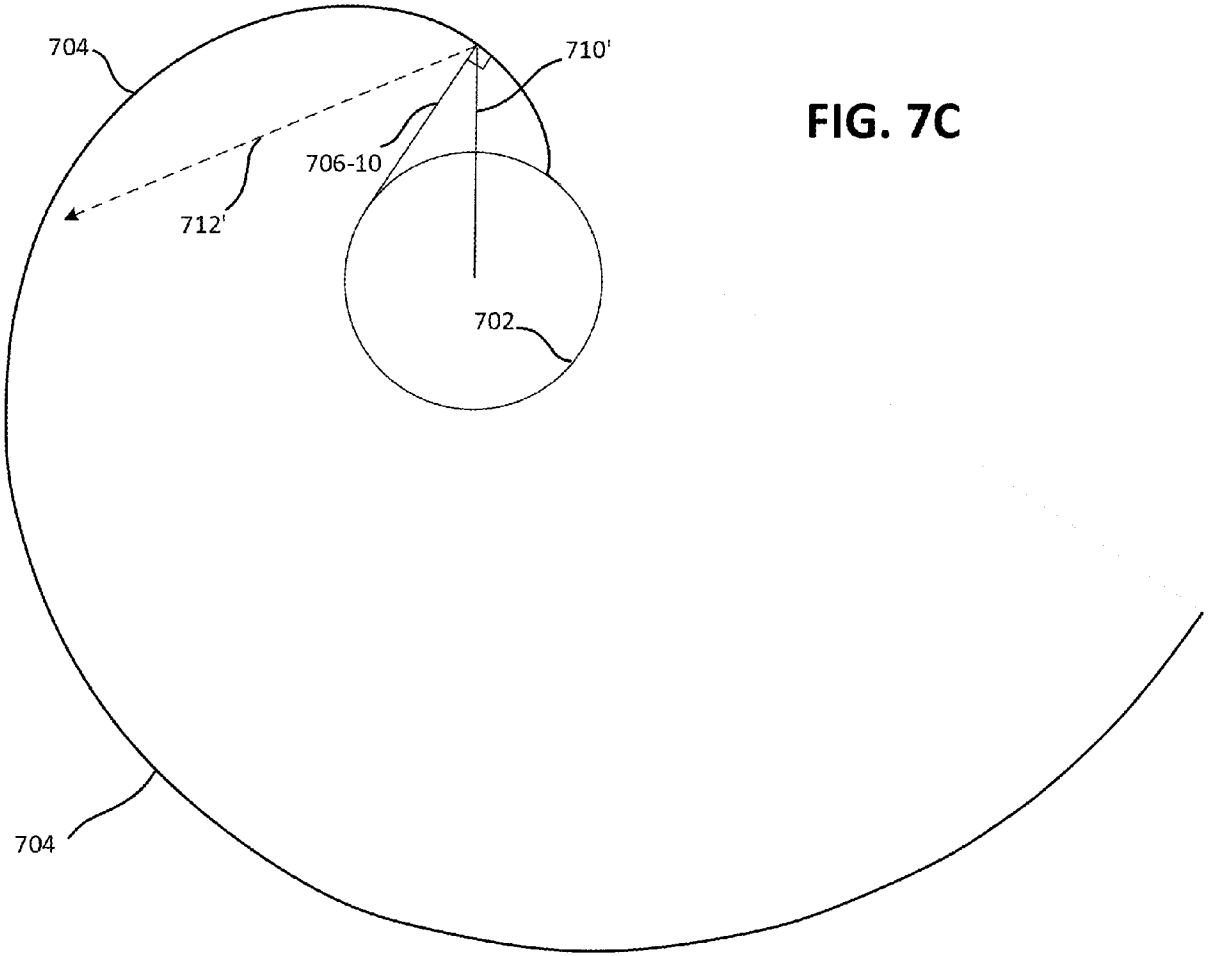

One property of involute curve 704 is that tangents of circle 702 are perpendicular to involute curve 704. Because lines 706-1 through 706-11 are tangent to circle 702, lines 706-1 through lines 706-11 are all perpendicular to involute curve 704. FIG. 7B demonstrates another property of involute curve 704. For simplicity, FIG. 7B shows circle 702, involute curve 704, and tangent line 706-7 of FIG. 7A. In FIG. 7B, a line is drawn from the center of circle 702 to the intersection of involute curve 704 with tangent line 706-7. Because tangent line 706-7 is perpendicular to involute curve 704, an angle A between line 710 and involute curve is less than 90°, e.g., angle A is I degrees less than 90°. If line 710 were a heat wave, such as one of heat waves 210, then, according to Snell's Law, the angle of reflection is equal to the angle of incidence. Thus, a reflected wave 712 is R degrees (R equal to I) below tangent line 706-7. Being below tangent line 706-7 means that reflected wave 712 clears circle 702 (e.g., emitting tube 202). As shown, involute curve 704 may vary in distance to tangents of circle 702 (e.g., emitting tube 202), but the distance, in one embodiment, may not exceed one half of the circumference The relationship shown in FIG. 7B may apply to all lines (e.g., emitted waves 210) from the center of circle 702 (e.g., emitting tube 202). Thus, as shown in FIG. 7C, an emitted wave 710' is reflected away from circle 702 as reflected wave 712'.

Figure 7D:
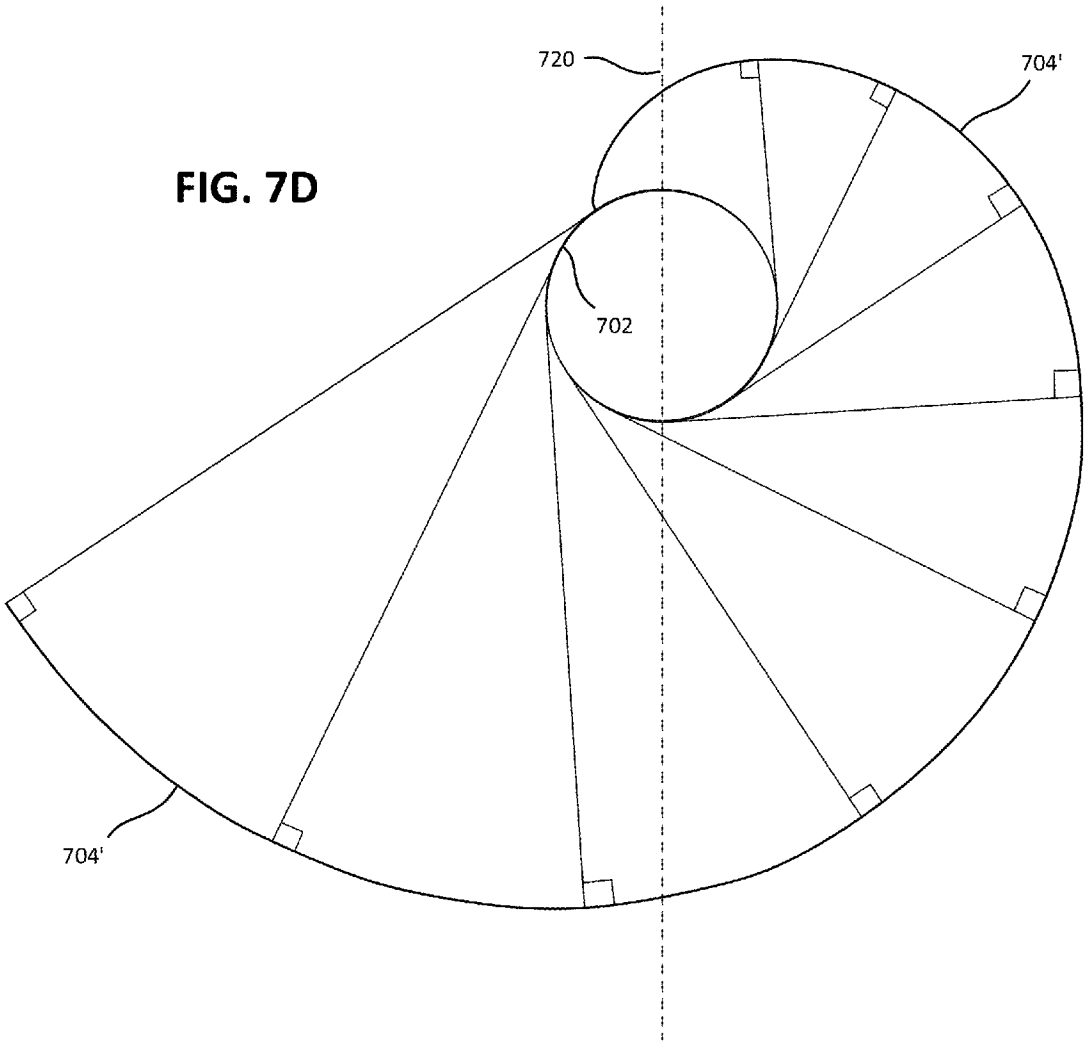
Figure 7E:
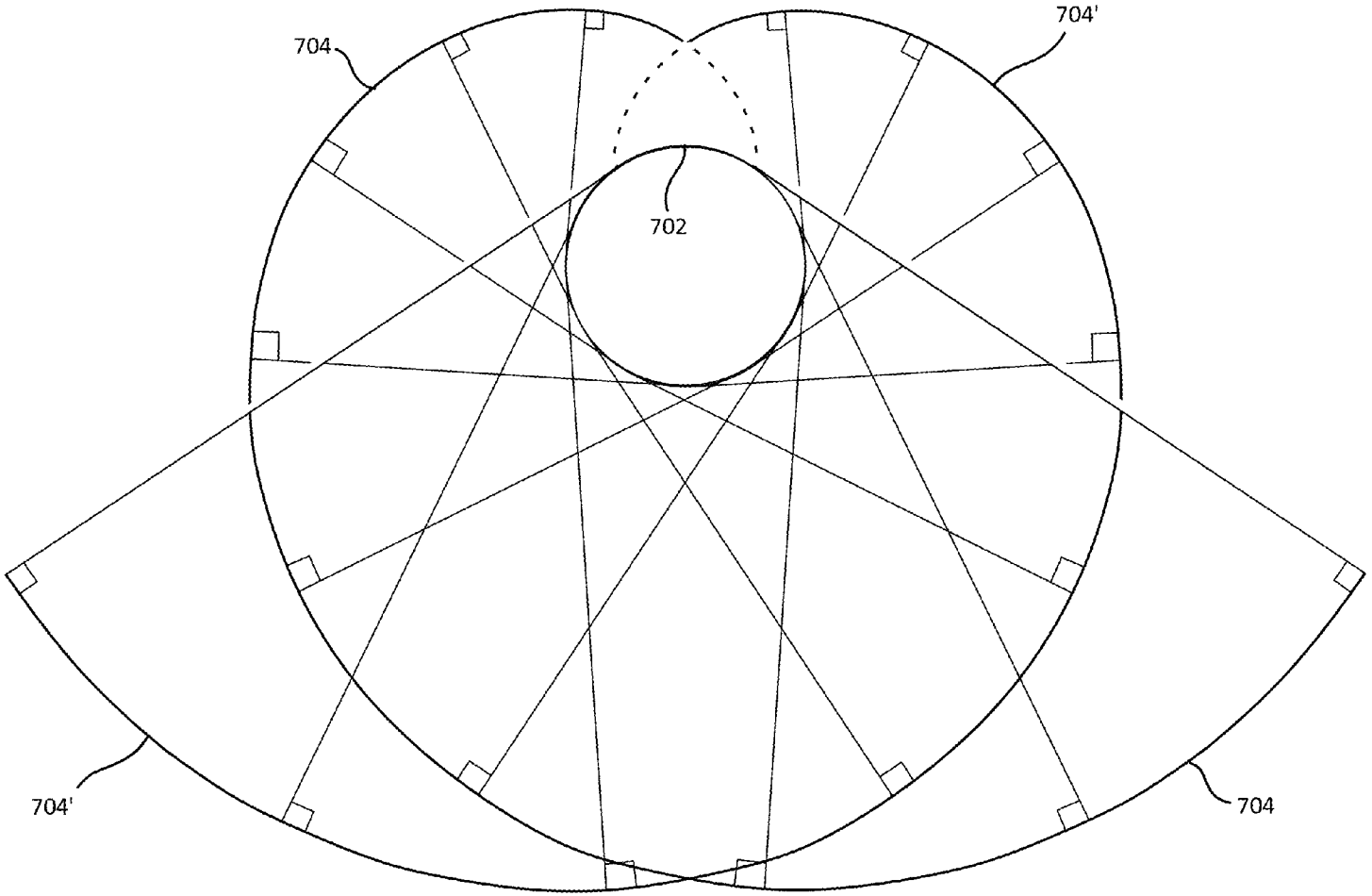
Figure 7F:
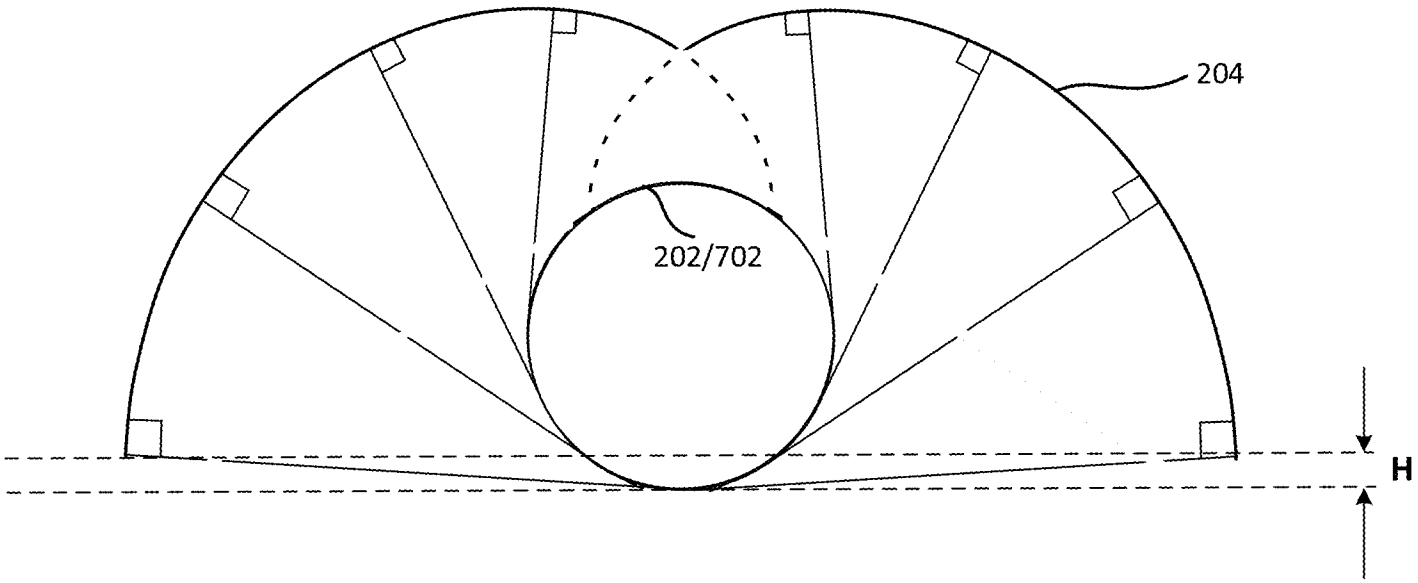

FIG. 7D shows another involute curve 704', which is symmetrical to involute curve 704 along a center line 720. FIG. 7E shows involute curve 704 and involute curve 704' superimposed on each other. Finally, FIG. 7F shows only a portion of the superimposed involute curves 704 and 704', the portion shown having the characteristics of reflector 204 discussed above with respect to FIG. 2B. As discussed above, heat waves emitted from emitting tube 202 (e.g., circle 702) are reflected down and away from emitting tube 202. In addition, emitting tube 202 is spaced apart from reflector 204. 204 may also be referred to as a "bi-involute" reflector.

The spacing between emitting tube 202 and reflector 204 may be the result of fixed point 708 not being directly above the center of circle 702. For example, in FIGS. 7A through 7F, fixed point 708 is approximately 29° away from being directly above the center of circle 702. Other angles are possible, such as an angle between approximately 0-5°, 5-10°, 10-15°, 15-20°, 20-25°, 25-30°, 30-35°, etc. (e.g., 5n to 5n+5, where n is zero or a positive integer). Angles above 360° are also possible. Curves 704 and 704' (e.g., reflector 204) may formed by circle 702 with a diameter of approximately 76.1 mm. Other diameters are possible, such as between 5-10 mm, 10-20 mm, 20-30 mm, 30-40 mm, 40-50 mm, 50-60 mm, 60-70 mm, 70-80 mm, 80-90 mm, etc. (e.g., 10u to 10u+10 mm, where u is a positive integer).

As shown in FIG. 7F, the surfaces of reflector 204 may end a distance H above the bottom of emitting tube 202. In one embodiment, H is chosen such that direct heat waves 210 disperse as widely as possible, but do not impinge on converter hood 402. In other words, H may be (1) large enough such that a straight line from line source P to the space just below the bottom edge of converter hood 402 is unobstructed by reflector 204; and (2) small enough such that a straight line from line source P to the space just above the bottom edge of converter hood 402 is obstructed by reflector 204. In this embodiment, direct heat waves 210 are dispersed as widely as possible, and heat waves 210 that would otherwise impinge on converter hood 402 are reflected. This embodiment also allows for more radiated heat waves 406 (emitted by converter hood 402) to reach floor 208 without impinging on converter hood 402 (as compared, for example, to H being zero or extending below the edge of converter hood 402).

As discussed above, these properties of reflector 204 may increase the heating efficiency of radiant heater 200 and radiant heater 400. These properties may also allow the temperature of emitting tube 202 to be lower than in conventional systems (as compared to emitting tube 102, for example).

Figure 8A:
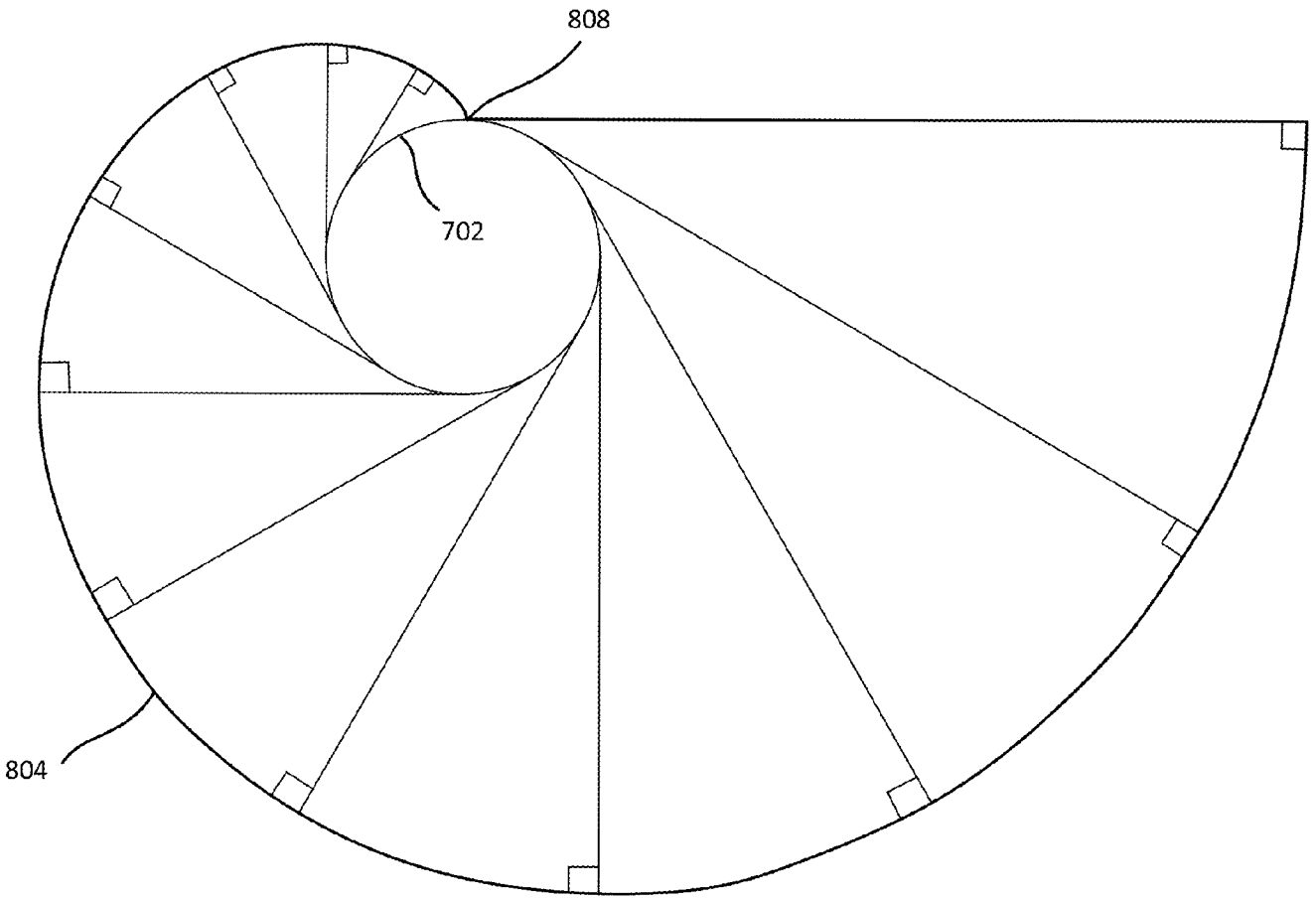
FIGS. 8A through 8D are additional plots of exemplary curves that describe the reflector of FIG. 3A.
Figure 8B:
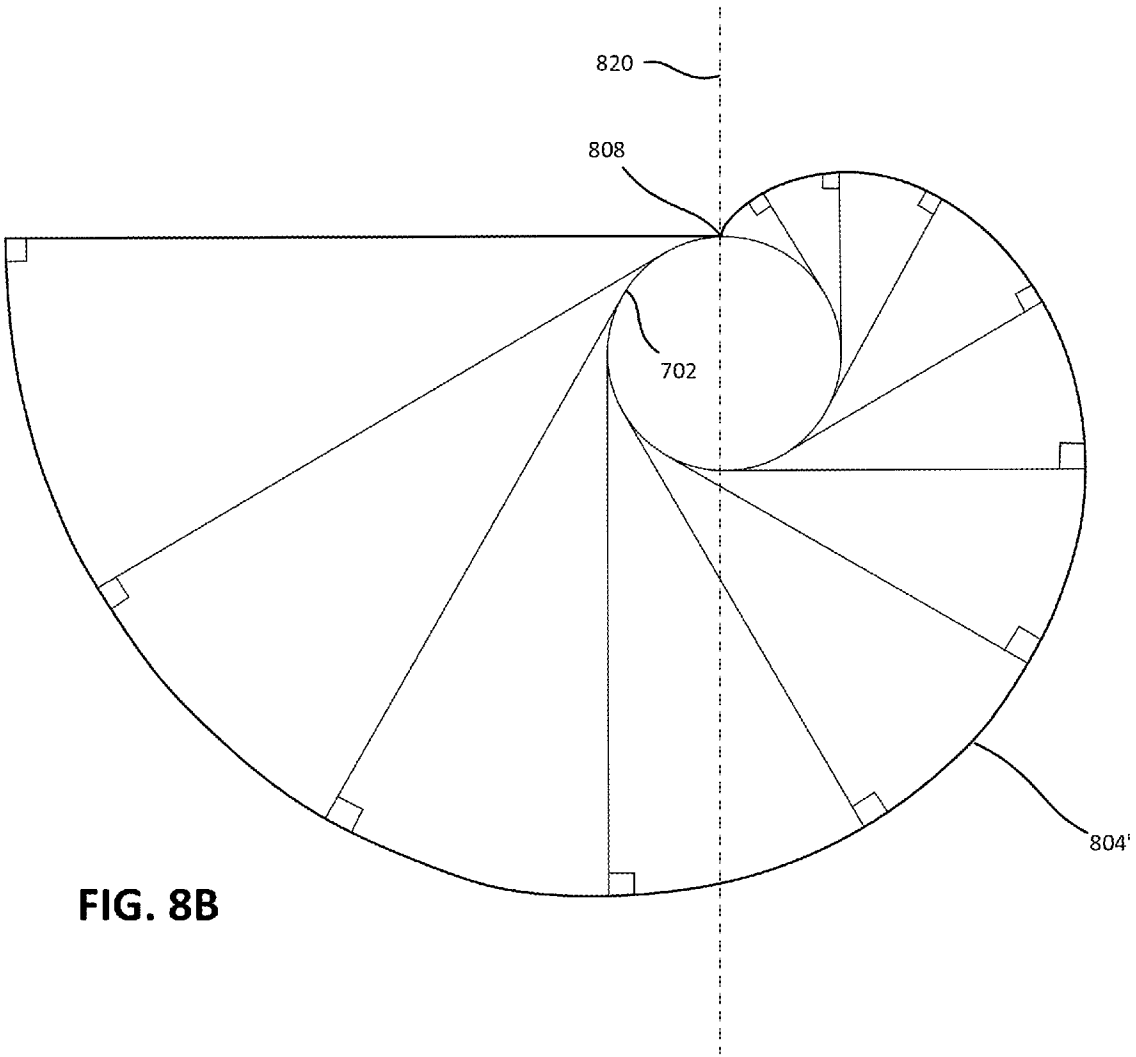
Figure 8C:
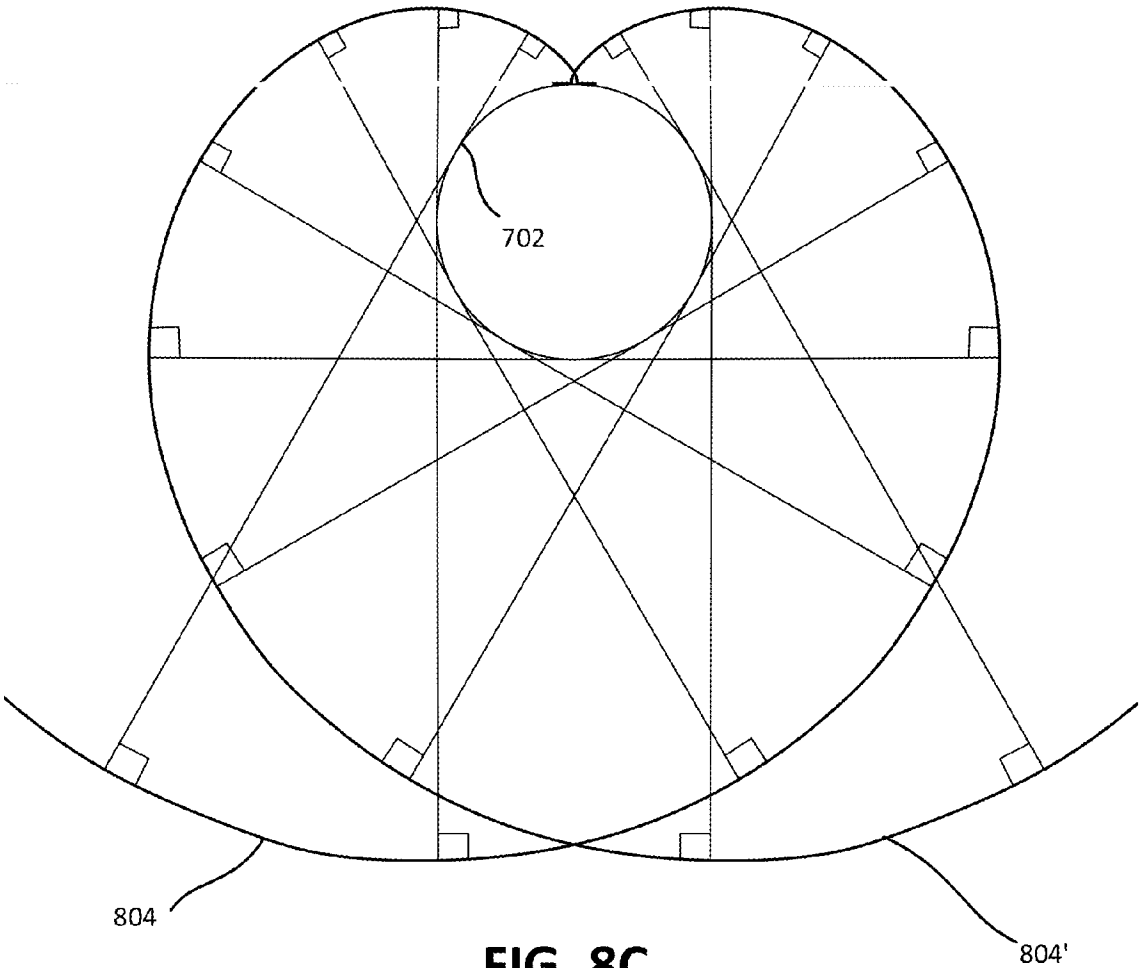
Figure 8D:
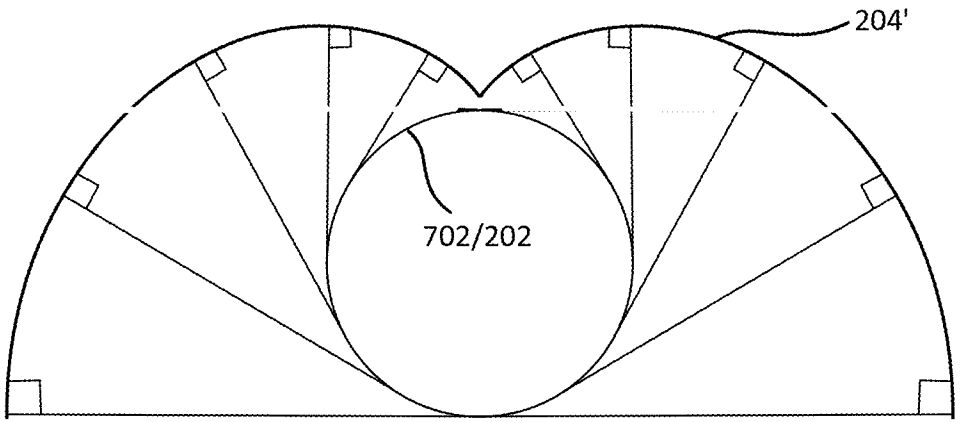

FIG. 8A is a diagram of an alternative involute curve 804 around circle 702. Involute curve 804 begins at fixed point 808, which is directly above the center of circle 702, unlike fixed point 708 which is not directly above the center of circle 702. FIG. 8B shows another involute curve 804', which is symmetrical to involute curve 804 along a center line 820. FIG. 8C shows involute curve 804 and involute curve 804' superimposed on each other. Finally, FIG. 8D shows only a portion of the superimposed involute curves 804 and 804' (e.g., reflector 204'), the portion shown having the characteristics similar to reflector 204 discussed above with respect to FIG. 2B. As discussed above, heat waves emitted from emitting tube 202 (e.g., circle 702) are reflected by reflector 204' down and away from emitting tube 202. In the design of reflector 204', however, the distance between emitting tube 202 and reflector 204' is less than with reflector 204. With reflector 204', however, an emitter tube may be used that has a smaller radius than emitting tube 202. In this case, the smaller emitter tube may be spaced farther from reflector 204', but may still have the same center as circle 702.

As discussed above, reflector 204/204' allows for more reflected energy to pass around emitting tube 202. The shape of reflector 204/204' may help reduce heat buildup under the reflector. Reducing heat under reflector 204/204' may result in lower temperatures on the hottest points of emitting tube 202. Thus, reflector 204/204' may increase the reflection efficiency and may increase the radiant efficiency of a heater. This greater efficiency may increase the reliability of the heater and the lifetime of the heater, as component temperature (e.g., the temperature of emitting tube 202) may be reduced. Because reflector 204/204' may reduce temperatures, relative to reflector 104, reflector 204/204' may allow an increased heat input to achieve the same reliability as reflector 104.

Returning to FIG. 2B, junction 220 is directly above emitting tube 202. A central axis (not shown) passes through source point P (the center of emitting tube 202) and junction 220. Surface 204-1 is such that radiation impinging on reflector 204 closer to junction 220 (and the central axis) is reflected (in its first reflection) farther away from the central axis than radiation impinging on reflector 204 farther away from junction 220. In other words, the reflected radiation creates the cross pattern shown in FIG. 2B. "Farther away," in this example means that the reflected energy (in the direction of its first reflection that does not cross the central axis) impinges floor 208 farther away from the central axis.

In addition, as shown in FIG. 2B, radiation is distributed across floor 208. In one embodiment, first surface 204-1 provides for a substantially even distribution of the reflected radiated energy—including areas directly under emitting tube 202 as well as outside the umbrella of reflector 204.

Embodiments described herein may allow for (1) higher heat output and/or higher radiant heat intensity, given the same input, for a radiant heater as compared to a conventional heater; (2) reduction of heat loss through roofs and walls; (3) lower and more even air temperatures in a heated area; (4) less thermal loss (e.g., through convection given higher radiant heat downward); (5) faster response and stabilization (e.g., resulting from increased radiant efficiency); and (6) reduced energy consumption (e.g., less fuel spent to heat fluids passing through emitting tubes) and lower carbon dioxide emissions.

As discussed above, in one embodiment, reflector 204 comprises a first sheet 302-1 and a second sheet 302-2 joined by multiple joining strips 310. In this exemplary embodiment, first sheet 302-1 and second sheet 302-2 do not include flange 306-1 and flange 306-2. Instead, an air gap may separate first sheet 302-1 and second sheet 302-2 (e.g., at junction 220), where the air gap is interrupted by joining strips 310. In this embodiment, heat transfer may occur through convection by air passing from space 206 to space 404 through the air gap between first and second sheets 302-1 and 302-2. In this embodiment, reflected radiation may not be reduced significantly because it is at junction 220 where radiation may otherwise reflect downward toward emitting tube 202. Converter hood 402 may include an angle immediately above junction 220 to reflect any radiation away from emitting tube 202. Alternatively, converter hood 402 may include a material directly above junction 220 to absorb the energy emitted by emitting tube 202 so that captured energy may be re-radiated from converter hood 402. Air gaps or holes may also be placed in other locations on reflector 204, such as periodically at the highest points of reflector 204 along its length.

In another embodiment, reflector 204 and/or emitting tube 202 may be suspended from converter hood 402 by a suspension mechanism (e.g., cables or long bolts). In this embodiment, heat may be transferred by conduction of heat along the suspension mechanism directly from reflector 204/space 204 to converter hood 402. In another embodiment, reflector 204 and/or emitting tube 202 may be connected to converter hood 402 through a metal conductor (other than a suspension mechanism) to transfer heat by conduction from reflector 204 and/or emitting tube 202 to converter hood 402.

In one embodiment, reflector 204 may be approximately 300 mm wide from edge to edge and 100 mm tall. In one embodiment, converter hood 402 may be approximately 700 mm wide from edge to edge and 170 mm tall.

The foregoing description of exemplary embodiments provides illustration and description, but is not intended to be exhaustive or to limit the embodiments described herein to the precise form disclosed. Modifications and variations are possible in light of the above teachings or may be acquired from practice of the embodiments.

For example, reflector 204 may be used in a radiant heater without the use or converter hood 402. In this example, an insulation layer (not shown) may be laid above reflector 204 to slow the heat transfer upward to reduce heat loss. Is another example, converter hood 402 may be used with reflectors of any shape, including reflector 104 of radiant heater 100. As another example, a curved surface other than a circle (e.g., an ellipse) may be used to create the involute shape of reflector 204, even though emitting tube 202 is still a circle. In this example, emitting tube 202 may still be within the radiation-free envelope created by the involute curved surface. Further, shapes that approximate or are substantially similar to the shape of reflector 204 and reflector 204' are possible.

As another example, first lip 304-1 and second lip 304-2 of reflector 204 may include another bend inward toward first sheet 302-1 and second sheet 302-2, respectively. In this embodiment, radiation 406 emitted by converter hood 402 may reflect away from reflector 204 rather than being trapped in the area formed by lips 304 and sheets 302.

As yet another example, in one embodiment, reflector 204 and converter hood 402 may both be mounted on the same support structure such that the spatial relationship between the two remains the same. In another embodiment, reflector 204, converter hood 402, and emitting tube 202 may be mounted on the same support structure such that the spatial relationship between the three remains the same. In another embodiment, emitting tube 202 and reflector 204 may be mounted on the same support structure so that the spatial relationship between the two remains the same. In this embodiment, reflector 204, converter hood 402, and/or emitting tube 202 may be sold, packaged, and shipped in a manner convenient for installation. In one embodiment reflector 204 and converter hood 402 may be integrally formed.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A system comprising:

a tube through which hot fluid is transported, wherein the tube radiates heat energy and transfers heat energy to surrounding air;

a reflector positioned on a first side of the tube, wherein the reflector is configured to reflect the radiated heat energy past the tube in an outward direction to a second side of the tube opposite the first side of the tube; and a hood positioned on the first side of the tube, wherein the reflector is positioned between the hood and the tube, wherein the hood surrounds the reflector forming an empty space between the reflector and the hood, a curved side of the hood having a radius of curvature that is greater than a radius of curvature of a correspondingly arranged curved surface of the reflector such that the arrangement of the hood relative to the reflector causes the empty space between the reflector and the hood to become increasingly larger in the outward direction, wherein the hood is configured to capture the heat energy from surrounding air and includes corrugations along the curved side that are configured to radiate the captured heat energy through the empty space between the reflector and the hood and past the reflector in substantially a same direction as the reflected radiated heat energy.

2. The system of claim 1, wherein the hood includes stainless steel.

3. The system of claim 2, wherein the hood captures heat energy from the surrounding air through convection and converts the heat energy into energy radiated through space.

4. The system of claim 3, further comprising an insulation layer on the hood on a side opposite the reflector.

5. The system of claim 1, wherein the reflector includes a curved surface that reflects heat energy around the tube, wherein substantially all of the reflected heat energy does not impinge on the tube.

6. The system of claim 5, wherein the reflector includes a substantially involute curved surface.

7. The system of claim 6, wherein the substantially involute curved surface includes a portion of an involute of a circle.

8. The system of claim 6, wherein a portion of the reflected heat energy impinges a point directly under the tube.

9. The system of claim 6, wherein the reflected heat energy is substantially evenly distributed beneath the reflector.

10. A radiant heating system comprising a hood, wherein the hood is configured to surround a reflector forming an empty space between the reflector and the hood, a curved side of the hood having a radius of curvature that is greater than a radius of curvature of a correspondingly arranged curved surface of the reflector such that the arrangement of the hood relative to the reflector causes the empty space between the reflector and the hood to become increasingly larger in an outward direction, wherein the reflector is configured to be positioned on a first side of a tube carrying hot fluid and to reflect heat energy radiated from the tube in the outward direction past the tube to a second side of the tube opposite the first side of the tube, wherein the hood is configured to be positioned on the first side of the tube and to capture heat energy from surrounding air through convection, convert the heat energy into energy radiated through the empty space between the reflector and the hood, and includes corrugations along the curved side that are configured to radiate the radiated energy through the empty space past the reflector in substantially a same direction as the reflected heat energy.

11. The radiant heating system of claim 10, wherein the hood further comprises a flat portion configured to be above the reflector and the reflector is configured to be above the tube carrying hot fluid.

12. The radiant heating system of claim 10, wherein the reflector includes a curved surface that reflects heat energy around the tube, wherein substantially all of the reflected heat energy does not impinge on the tube, and wherein the hood is configured to receive an insulation layer on a side opposite the reflector.

13. The radiant heating system of claim 12, wherein the reflector includes a substantially involute curved surface.

14. A radiant heating system comprising a reflector, wherein the reflector is configured to reflect heat energy radiated from a tube carrying hot fluid, wherein the reflector is configured to be positioned on a first side of the tube, wherein the reflector includes a curved surface that reflects heat energy around the tube from the first side to a second side of the tube opposite the first side, wherein substantially all of the reflected heat energy does not impinge on the tube, wherein the radiant heating system includes a hood configured to surround the reflector, such that the reflector is situated between the hood and the tube and an empty space is formed between the hood and the reflector, a curved side of the hood having a radius of curvature that is greater than a radius of curvature of a correspondingly arranged curved surface of the reflector such that the arrangement of the hood relative to the reflector causes the empty space between the reflector and the hood to become increasingly larger in an outward direction, and wherein the hood is configured to capture heat energy from surrounding air and includes corrugations along the curved side that are configured to radiate the captured heat energy through the empty space between the hood and the reflector and past the reflector in substantially a same direction as the reflected heat energy.

15. The radiant heating system of claim 14, wherein the reflector includes a substantially involute curved surface.

16. The radiant heating system of claim 14, wherein the hood captures heat energy from surrounding air through convection and converts the heat energy into energy radiated through space.

17. The radiant heating system of claim 16, wherein the hood is configured to receive an insulation layer on a side opposite the reflector.

18. The radiant heating system of claim 14, wherein a portion of the curved surface varies in distance to a tangential point on the tube, wherein the distance does not exceed one half of a circumference of the tube.

* * * * *

UNITED STATES PATENT AND TRADEMARK OFFICE

CERTIFICATE OF CORRECTION

PATENT NO. : 9,022,298 B2
APPLICATION NO. : 12/563428
DATED : May 5, 2015
INVENTOR(S) : Catteau et al.

It is certified that error appears in the above-identified patent and that said Letters Patent is hereby corrected as shown below:

Title page, item (75), in "Inventors", in column 1, line 1, delete "la" and insert --La--, therefor Title page, item (75), in "Inventors", in column 1, line 2, delete "Lyons" and insert --Lyon--, therefor Signed and Sealed this
Twenty-eighth Day of June, 2016

Michelle K. Lee

Michelle K. Lee
*Director of the United States Patent and Trademark Office*